US009895015B2

(12) United States Patent
Salles, Jr. et al.

(10) Patent No.: US 9,895,015 B2
(45) Date of Patent: Feb. 20, 2018

(54) SPILL RESISTANT CUP WITH PREDICTABLE LANDING POSITIONS

(71) Applicant: No Spill Technologies, LLC, Slidell, LA (US)

(72) Inventors: David Christopher Salles, Jr., Slidell, LA (US); Armond Albert Kaiser, Diamondhead, MS (US); Steven Swisher, Tulsa, OK (US)

(73) Assignee: No Spill Technologies, LLC, Slidell, LA (US)

( * ) Notice: Subject to any disclaimer, the term of this patent is extended or adjusted under 35 U.S.C. 154(b) by 315 days.

(21) Appl. No.: 14/657,108

(22) Filed: Mar. 13, 2015

(65) Prior Publication Data

US 2015/0182050 A1 Jul. 2, 2015

Related U.S. Application Data

(63) Continuation-in-part of application No. 14/211,365, filed on Mar. 14, 2014, now abandoned.

(60) Provisional application No. 61/790,803, filed on Mar. 15, 2013.

(51) Int. Cl.
*A47G 19/22* (2006.01)

(52) U.S. Cl.
CPC ..... *A47G 19/2272* (2013.01)

(58) Field of Classification Search
CPC ..... B65D 43/0212; B65D 43/0206; B65D 51/16; B65D 51/1611; B65D 51/18; B65D 47/06; B65D 81/262; B65D 2251/0025; B65D 2251/0056; B65D 2251/0087; B65D 2543/00046; B65D 2543/00092; A61J 11/008; A61J 11/04; A61J 11/045; A47G 19/22; A47G 19/2211; A47G 19/2266; A47G 19/2272; G01F 11/262
USPC ... 220/371–372, 501, 592.17, 703, 709, 711, 220/713–714, 716, 719; 215/11.1, 215/11.4–11.6, 229, 379, 382–384; D7/510–511; D9/428, 430–432
See application file for complete search history.

(56) References Cited

U.S. PATENT DOCUMENTS

| | | | |
|---|---|---|---|
| 2,143,027 | A | 8/1935 | Perry |
| 2,278,586 | A | 5/1940 | Potter |
| 2,414,697 | A | 9/1945 | Pettersson |
| 2,597,522 | A | 12/1947 | Pierce |
| 4,441,640 | A | 4/1984 | Lottick |
| 4,986,437 | A | 1/1991 | Farmer |

(Continued)

FOREIGN PATENT DOCUMENTS

CN 202445711 9/2012

*Primary Examiner* — Chun Cheung
*Assistant Examiner* — Brijesh V. Patel
(74) *Attorney, Agent, or Firm* — Head, Johnson, Kachigian & Wilkinson, PC

(57) ABSTRACT

A spill resistant cup comprising: a substantially hollow body; a lid, where the lid is removably attached to the body such that the lid spans the top of the body and where the top of the lid has an opening; and an insert located between and spaced from the top of the lid and the bottom of the body, where the insert has an opening and where the opening in the insert aligns with the opening in the lid. The insert, along with the alignment of the openings, allows a user to drink from the cup unimpeded while preventing liquid from within the cup from spilling out in significant quantities when the cup is tipped over.

18 Claims, 8 Drawing Sheets

(56) References Cited

U.S. PATENT DOCUMENTS 5,150,800 A * 9/1992 Sarter ..... A47G 19/2272 215/11.1
5,454,482 A 10/1995 Simon
D364,315 S 11/1995 Humphrey et al.
5,560,513 A 10/1996 Jarrell
5,890,621 A * 4/1999 Bachman ..... A47G 19/2272 215/11.4
5,938,053 A * 8/1999 Verbovszky ..... A47G 19/2272 215/11.1
6,065,635 A 5/2000 Sullivan
D461,097 S 8/2002 Nemirovsky
6,626,314 B1 * 9/2003 McHenry ..... B65D 17/165 220/254.2
6,705,485 B1 3/2004 Sato et al.
7,073,678 B1 * 7/2006 Dibdin ..... A47G 19/2272 220/254.1
7,314,136 B2 1/2008 Stefandl
D589,752 S 4/2009 Fetting
D603,219 S 11/2009 Lopez
8,061,197 B2 11/2011 Silvers
2002/0027137 A1 * 3/2002 Price ..... A47G 19/2272 220/23.87
2002/0139767 A1 10/2002 Budd
2004/0232154 A1 11/2004 Smith et al.
2005/0072787 A1 4/2005 Morris et al.
2005/0167439 A1 8/2005 Chandler et al.
2006/0169694 A1 8/2006 Kemper
2007/0187406 A1 * 8/2007 Nobile ..... B65D 83/0811 220/254.4
2008/0128438 A1 6/2008 Lane
2008/0264960 A1 10/2008 Phillips et al.
2009/0108003 A1 * 4/2009 Tripsianes ..... A47G 19/2272 220/521
2010/0018975 A1 * 1/2010 DeMarco ..... B65D 47/265 220/253
2010/0294764 A1 11/2010 Kemper et al.
2011/0079570 A1 4/2011 Brown et al.
2011/0309093 A1 * 12/2011 Buck ..... A47G 19/2205 220/711
2012/0037669 A1 * 2/2012 Goetz ..... A47G 19/34 222/456
2012/0187066 A1 * 7/2012 Redl ..... A47J 41/0038 215/11.2

* cited by examiner

SPILL RESISTANT CUP WITH PREDICTABLE LANDING POSITIONS

CROSS REFERENCE

This application is based on and claims priority to U.S. Application No. 61/790,803 filed Mar. 15, 2013 and U.S. application Ser. No. 14/211,365 filed Mar. 14, 2014, which are incorporated herein by reference.

BACKGROUND OF THE INVENTION

Field of the Invention

This invention relates generally to a cup, and more particularly, but not by way of limitation, to a spill resistant transition cup.

Description of the Related Art

The transition from baby bottles to drinking from a regular cup is difficult for children. The mechanism of drinking is different, and a cup must be held more carefully than a baby bottle to prevent spills. Many children stop drinking from baby bottles before they have the dexterity necessary to drink from a cup without spilling its contents. One common solution is the sippy cup. A sippy cup typically has a lid with a spout and a valve, through which the contents of the cup may be drunk. The valve helps prevent spills should the sippy cup tip over.

The valve forces a user to suck on the spout, making the mechanism of drinking from a sippy cup similar to that of drinking from a baby bottle. The sucking process can also cause excruciating inner ear pain in children that are experiencing sinus congestion and/or infections. The valve is often made of silicone or a similar substance that must be separately washed. Washing a valve may be quite difficult due to its shape, and thus sippy cup valves are frequently less than ideally clean and often require regular replacement. Constantly sucking on sippy cup spouts may adversely affect the development of a child's teeth and mouth. Similarly, chewing on a sippy cup spout, as often happens, may not be healthy for the child. The use of a sippy cup may also discourage a child from learning how to properly drink from a regular cup, as the sippy cup may be held at any angle while drinking without spilling.

Other populations would likewise benefit from a cup that is spill resistant, such as the elderly and those with dexterity issues.

Based on the foregoing, it is desirable to provide an alternative to the sippy cup that provides a proper transition from a baby bottle to a standard drinking cup.

It is further desirable to provide a cup that simulates the feeling of drinking from a regular cup while providing some spill resistance.

It is further desirable to provide a spill resistant cup that does not have a valve.

It is further desirable to provide a spill resistant cup that encourages children to learn how to hold a cup properly while drinking from it to prevent spills.

SUMMARY OF THE INVENTION

In general, in a first aspect, the invention relates to a spill resistant cup comprising: a substantially hollow body with a top and a bottom, where the bottom of the body is closed and the top of the body is open; a lid with a top and at least one side wall, where the lid is removably attached to the body such that the lid spans the top of the body and where the top of the lid has an opening; and an insert located between and spaced from the top of the lid and the bottom of the body, where the insert has an opening and where the opening in the insert aligns with the opening in the lid. The body may have one or more flat panels such that when the cup tips over it tends to rest on one of the one or more flat panels. The opening in the lid may not align with any of the one or more flat panels of the body.

The body may have a rim adjacent the top, the lid may have a rim, and the lid may removably attach to the body via the two rims. The at least one sidewall of the lid may comprise the rim of the lid. The rim of the body may have a tab and the rib of the lid may have a corresponding recess such that the lid may be removably attached to the body in only one orientation. The rim of the body may have threads and the rim of the lid may have corresponding threads such that the lid may be screwed onto the body.

The top of the lid may have a truncated hyperbolic paraboloid shape. The at least one sidewall of the lid may have one or more flat portions aligned with the one or more flat panels of the body. The spill resistant cup may further comprise a trough located adjacent the opening in the lid such that liquid must travel along the trough to exit the cup via the opening in the lid. The lid may further comprise a vent hole, and the insert may further comprise a vent hole. The vent hole in the insert and the opening in the insert may be a single slit. The insert may be removably attached to the lid, or may be integral to the lid. A hood may be located between the opening in the insert and the opening in the lid. One or more posts may extend downward from the insert. The one or more posts may be located adjacent the opening in the insert. The cup may be insulated.

In a second aspect the invention relates to a spill resistant cup comprising: a substantially closed vessel with an interior shape defining an interior space, where the vessel has a top and an opposing bottom, and where the vessel is shaped such that it has one or more predictable landing positions, where a landing position is a position in which the cup comes to rest when placed on a surface other than on its bottom; an opening in the top of the vessel, where the opening is positioned such that it is not down when the cup is in any of the predictable landing positions; and an insert between the top and the bottom of the vessel with an opening aligned with the opening in the top of the vessel, where the insert has a perimeter matching the interior shape of the vessel at the location of the insert such that liquid cannot travel past the insert other than through the opening in the insert.

Other advantages and features will be apparent from the following description and from the claims.

DETAILED DESCRIPTION OF THE INVENTION

The devices and methods discussed herein are merely illustrative of specific manners in which to make and use this invention and are not to be interpreted as limiting in scope.

While the devices and methods have been described with a certain degree of particularity, it is to be noted that many modifications may be made in the details of the construction and the arrangement of the devices and components without departing from the spirit and scope of this disclosure. It is understood that the devices and methods are not limited to the embodiments set forth herein for purposes of exemplification.

Figure 1:
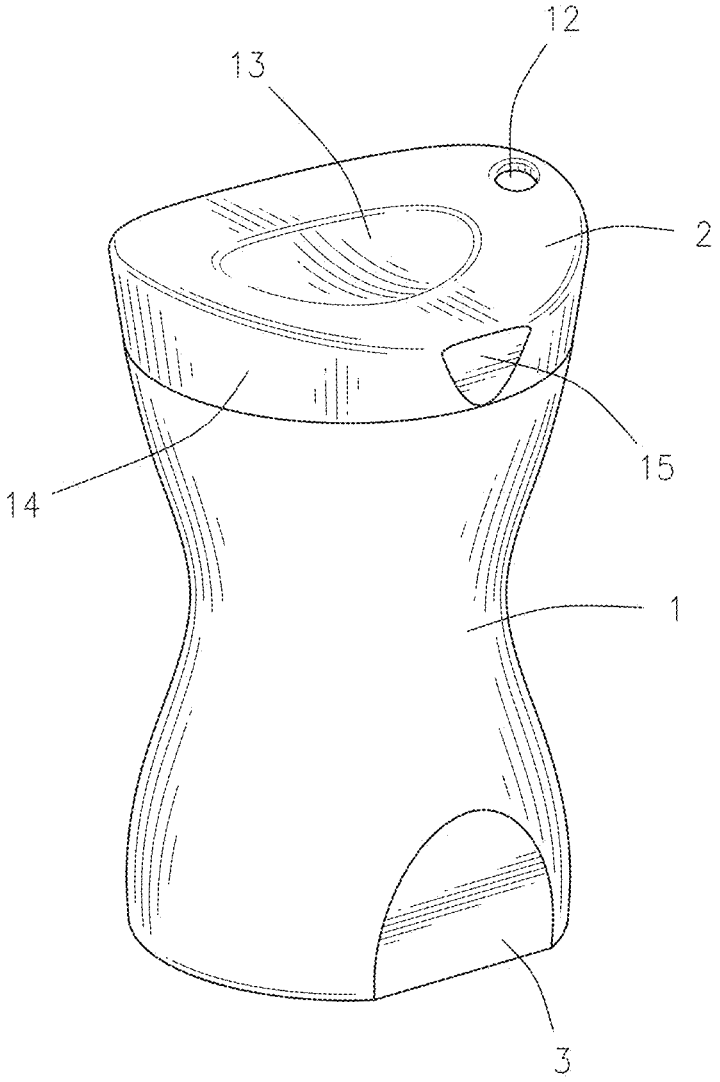
FIG. 1 is a perspective view of the spill resistant cup.
Figure 4:
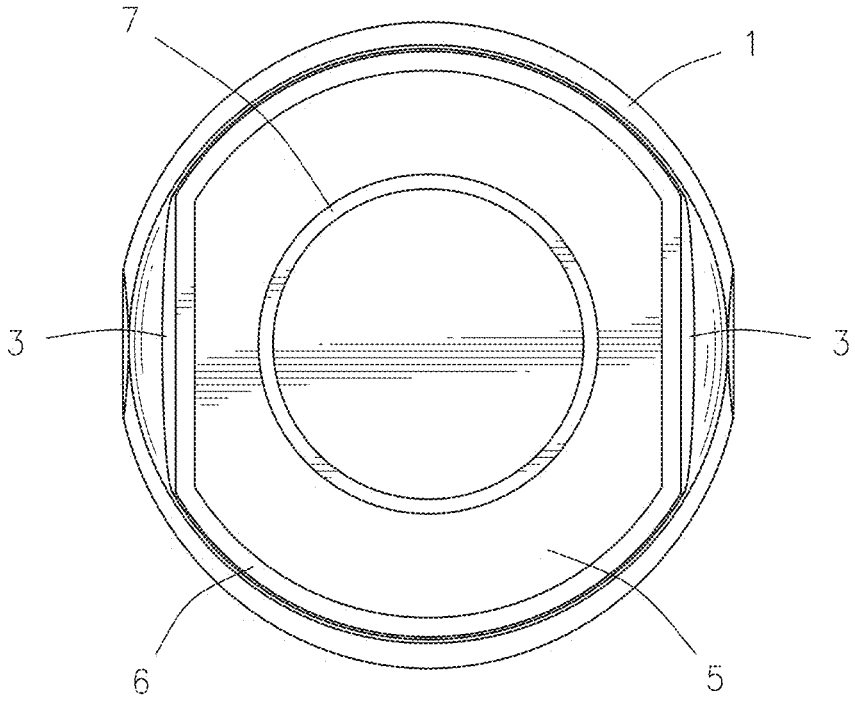
FIG. 4 is a bottom view of the spill resistant cup.
Figure 5:
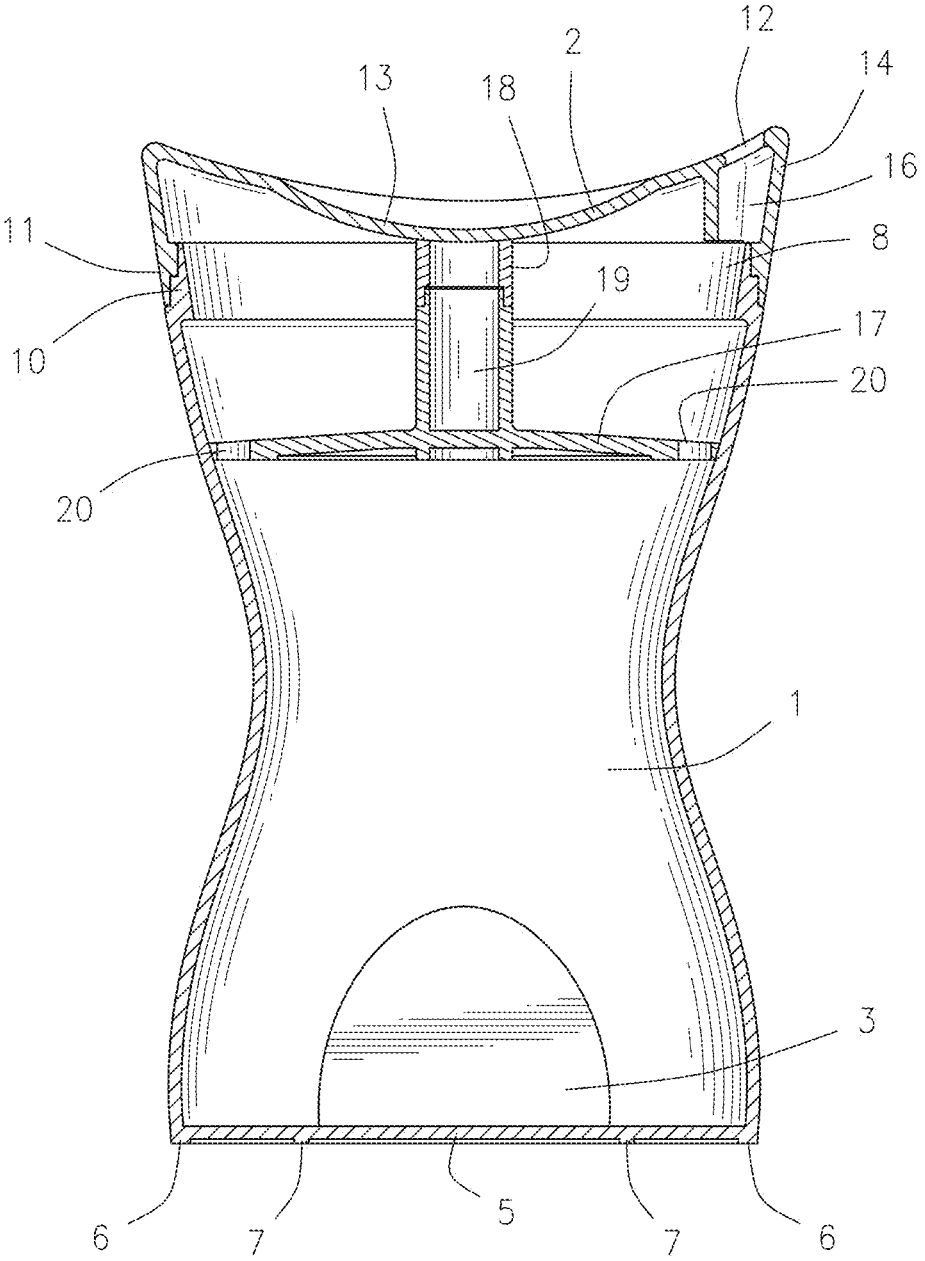
FIG. 5 is a cut away view of the spill resistant cup.
Figure 12:
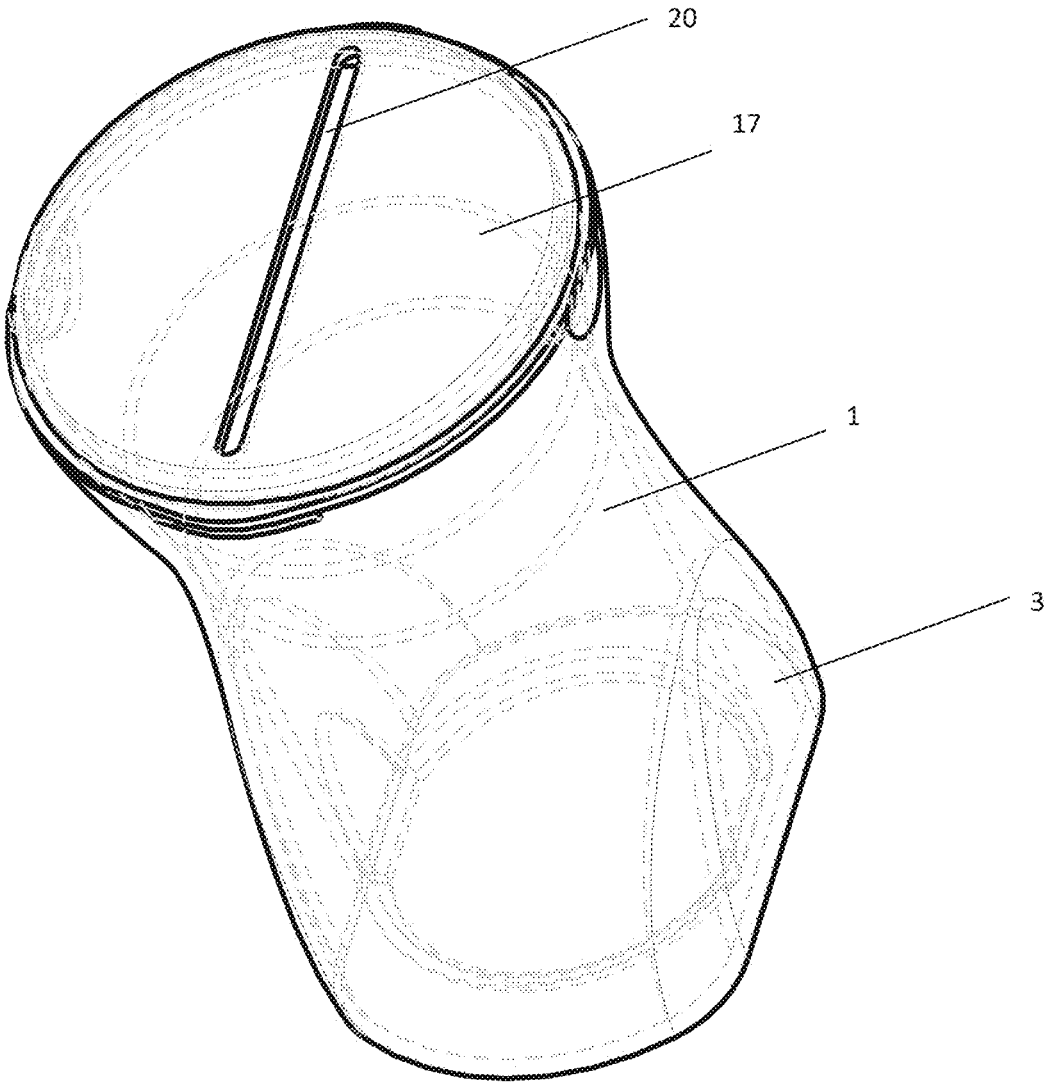
FIG. 12 is a perspective view of the spill resistant cup with insulation and an alternate insert design.

In general, in a first aspect, the invention relates to a spill resistant cup with a body 1 and a lid 2, as seen in FIG. 1. The body 1 may be hollow, such that it may hold fluid for drinking. The body 1 may be at least partially curved, and may have at least one flat portion 3 to encourage the spill resistant cup to settle on the flat portion 3 if tipped over. Alternately, the flat portion 3 may not be flat, but may be substantially flat, gently curved, or curved. The body 1 may be generally cylindrical or may have an hourglass shape, as shown, or any other desired shape. For example, the body 1 may be an elliptic cylinder or other cylinder with a non-circular cross section, such as an oval cross section. If so, the flat portion 3 may not be flat, but may be merely an area along the existing curve of the cylinder. The body 1 may have an open top 4 and a closed bottom 5. The bottom 5 may be generally flat, and may have a protrusion 6 along its edge and a circular protrusion 7 on its face, as shown in FIGS. 4 and 5. The body 1 may optionally be at least partially insulated, as shown in FIG. 12.

The body 1 may have a rim 8 extending upward adjacent its open top 4. The lid 2 may have a corresponding rim 9 extending downward, such that lid 2 may attach to the body 1 along the rims 8 and 9. Rim 8 may have a tab 10 and rim 9 may have a corresponding recess 11, ensuring that the lid 2 is placed on the body 1 in a desired orientation. In general, it is desirable for the flat portion 3 not to align with any opening in the lid 2 to minimize the possibility of liquid escaping the spill resistant cup if it tips over and comes to rest on the flat portion 3. The tab 10 and recess 11 may be oriented such that the flat portion 3 is 90° from the opening 12 in the lid 2, as shown.

The rims 8 and 9 may form a twist lock, such that the lid 2 may be placed on the body 1 and twisted a short distance, causing the twist lock to engage, thus preventing the lid 2 from being removed from the body 1 without untwisting. Alternately, the rims 8 and 9 may be threaded such that they may be joined to each other by twisting. Alternately, the rims 8 and 9 may join together through a friction fit. Alternately, the rims 8 and 9 may have any other appropriate mechanism for attaching to one another such that the lid 2 may be secured to the body 1 via the rims 8 and 9. The spill resistant cup may have a gasket (not shown) located at the rims 8 and 9 to prevent leakage of fluid from the cup.

Figure 6:
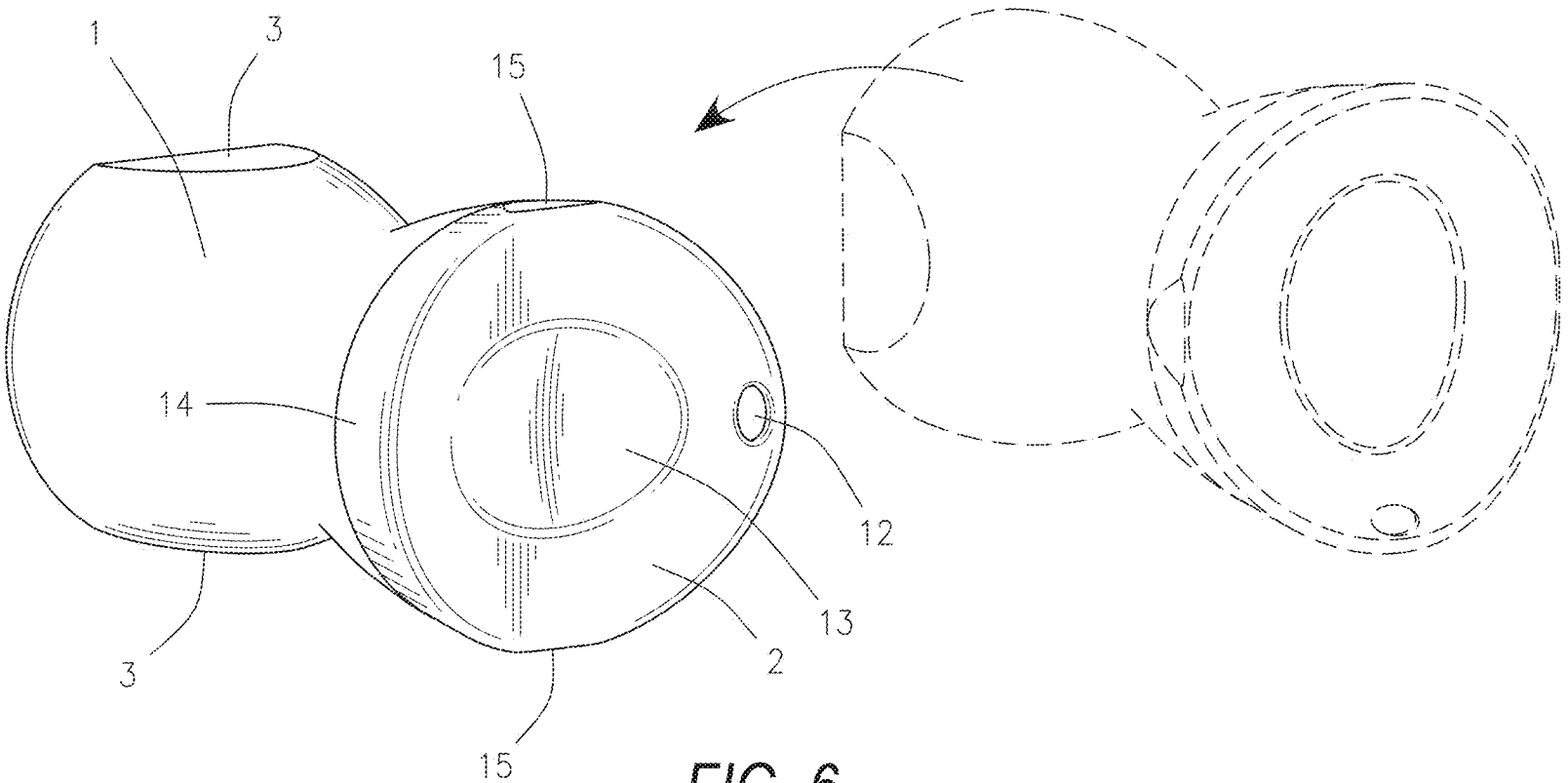
FIG. 6 is a perspective view of the spill resistant cup, showing the cup landing on its front and coming to rest on its side.
Figure 7:
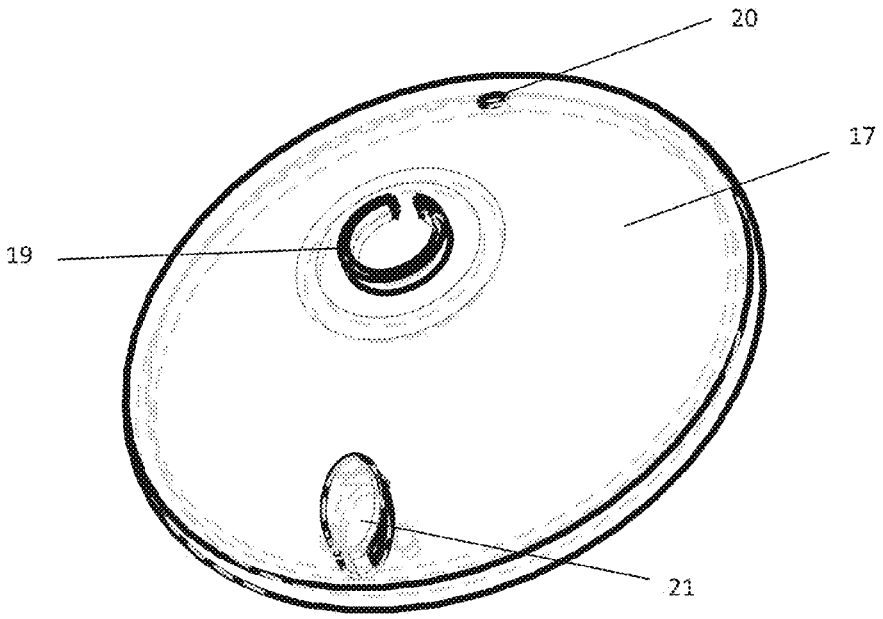
FIG. 7 is a perspective view of an alternate insert design.
Figure 8:
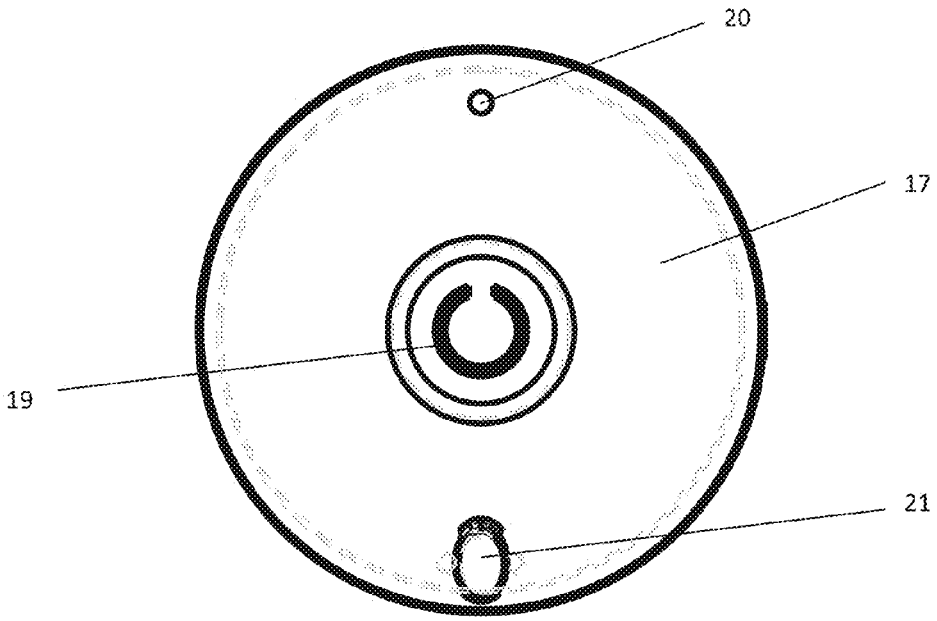
FIG. 8 is a top view of the alternate insert design.
Figure 9:
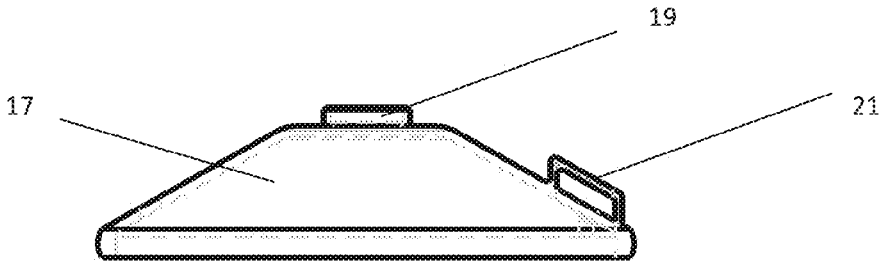
FIG. 9 is a side view of the alternate insert design.
Figure 10:
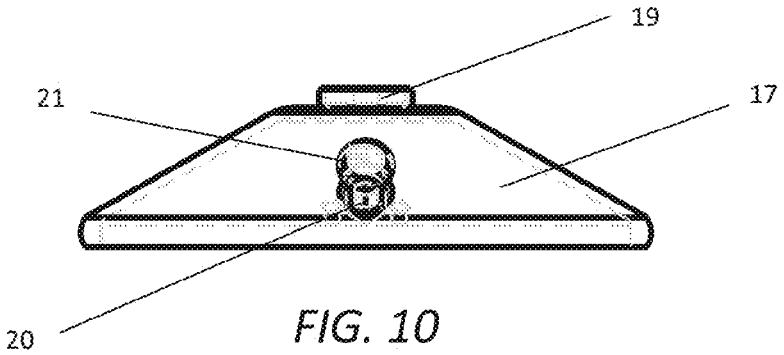
FIG. 10 is a front view of the alternate insert design.
Figure 11:
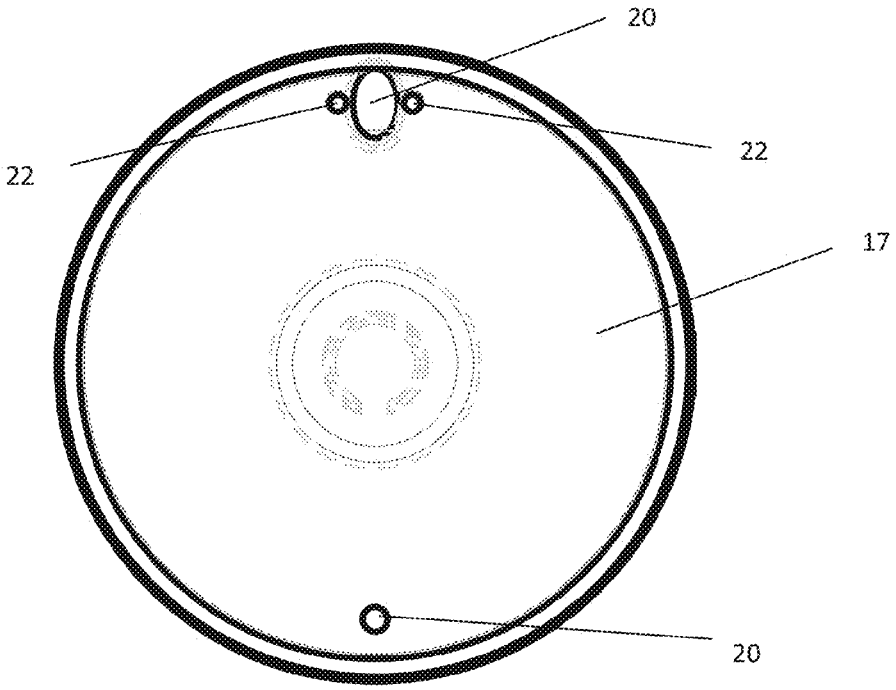
FIG. 11 is a bottom view of the alternate insert design.

The lid 2 may have an opening 12 through which liquid in the cup may be drunk by a user. The opening 12 may be circular or oval-shaped, as shown in FIGS. 1 through 3 and 6, or any other desired shape. A vent hole may be located in the lid 2 opposite the opening 12. The lid 2 may be saddle-shaped or, more particularly, shaped like a truncated hyperbolic paraboloid, as shown. This shape may make it difficult for the cup to rest upside down on the lid 2, encouraging the cup to rest on its side if dropped. Alternately, the lid may have any desired shape. The lid 2 may have a center depression 13, which may be oval-shaped. The lid 2 may have a generally vertical side wall 14, which may be generally curved. The side wall 14 may have at least one flat portion 15, which may align with the at least one flat portion 3 to further encourage the cup to rest along these flat portions 3 and 15 when tipped over, as shown in FIG. 6. Again, the flat portion 15 may or may not be actually flat, depending on the geometry of the lid 2. The flat portion 15 may not align with the opening 12. The opening 12 may be located at a point 90° from the flat portion 15, or otherwise out of alignment such that the opening 12 is not pointed downward when the cup is resting on the flat portion 15. The front of the lid 2 may be higher or lower than the back of the lid 2, again to encourage the cup to tip onto its side if it lands or is placed upside down on its top.

The lid 2 may have a trough 16 adjacent the opening 12 such that liquid from within the cup must travel along the trough 16 to exit the cup via the opening 12. When the cup is upside down or on its side, this trough 16 may prevent liquid that has collected within the lid 2 behind the trough 16 from reaching the opening 12.

The lid 2 may have a vent hole located opposite the opening 12 to allow air to enter the cup when the user is drinking or pouring liquid from the opening 12.

Figure 2:
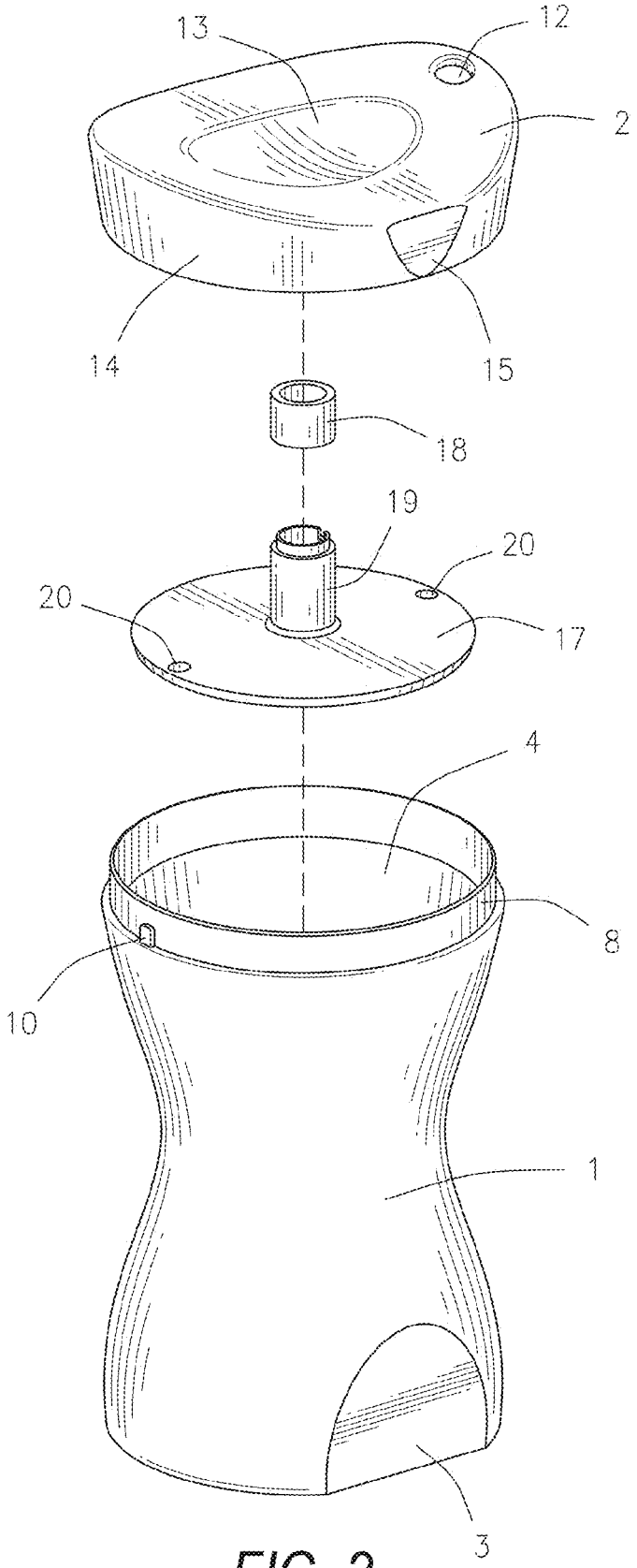
FIG. 2 is an exploded view of the spill resistant cup.
Figure 3:
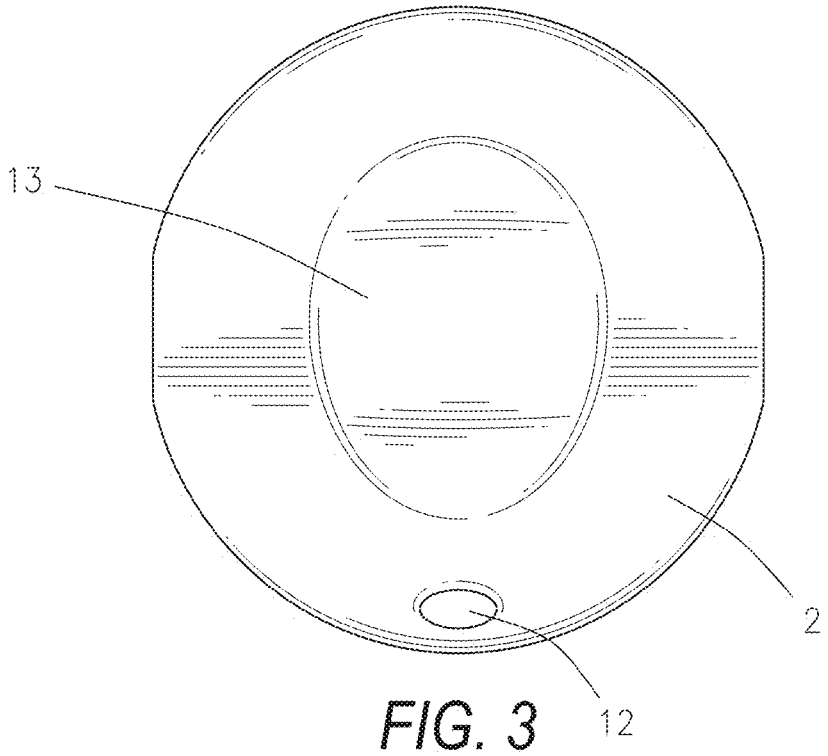
FIG. 3 is a top view of the spill resistant cup.

An insert 17 may be attached to and extend downward from the lid 2. The insert 17 may be attached to the lid 2 either permanently or removably via one or more elongate structures or assemblies. For example, as shown in FIG. 2, the insert 17 may be attached to the lid 2 via a single assembly comprising a first cylinder 18, which may be attached to the lid 2, and a second cylinder 19, which may extend upward from the insert 17. The second cylinder 19 may removably attach to the first cylinder 18, allowing the insert 17 to be easily removed for cleaning. The insert may extend into the body 1 and may be circular or other shape to match the shape of the interior of the body 1 at the point the insert 17 hits. The insert 17 may be sized such that it fits closely along the interior wall of the body 1, preventing liquid from traveling between the insert 17 and the wall of the body 1. The insert 17 may have one or more holes 20 therethrough. As shown in FIG. 2, one hole 20 may be aligned with the opening 12 in the lid 2, while a second hole 20 may be opposite the first hole 20, allowing air to travel from above the insert 17 to below the insert 17 when liquid is traveling through the hole 20 aligned with the opening 12. The second hole 20 may be smaller than the first hole 20 to minimize how much liquid can travel through the second hole 20 when the cup is dropped or tipped other than during proper use. Alternately, the hole 20 may be a single slit extending across the insert 17, as shown in FIG. 12. The slit design would allow liquid to travel through one end of the slit while air is vented through the opposite end of the slit. If the hole 20 is a slit, it may be parallel to the flat portion 15 or the plane in which the flat portion 15 lies, if the flat portion 15 is not flat, so that the hole 20 is not pointed downward when the cup is resting on the flat portion 15.

The insert 17 may be substantially flat, as shown in FIG. 2, or may be angled, as shown in FIGS. 7 through 11. A hood 21 may extend upward from the insert 17 and over the first hole 20, preventing liquid splashing through the first hole 20 from traveling directly to the opening 12 in the lid 2, thus further preventing unwanted spills. The hood 21 may be open on its sides to allow liquid traveling through the first hole 20 to continue to the opening 12 when the cup is tipped intentionally. One or more posts 22 may extend downward from the insert 17 near the first hole 20 to prevent ice located within the cup from blocking the first hole 20 during use.

During use, a user may drink from the cup via the opening 12. As the user tips the cup to drink from the opening 12, liquid from within the body 1 may travel through the hole 20, along the trough 16, and out the opening 12 unimpeded, simulating the experience of drinking from a regular cup or glass. If the cup is tipped in any other direction, the amount of liquid that can travel through the holes 20 may be limited by their location. For example, if the cup is tipped on its side, no liquid can reach the holes 20 unless the cup is more than half full. If it is more than half full, the speed at which liquid can travel through the holes 20 may be limited because both holes will be covered with liquid, creating a weak vacuum. Any liquid that does travel through the holes 20 would then have to fill the space between the insert 17 and the lid 2 at least halfway to reach the opening 12, which may further limit the quantity and speed of liquid that ultimately spills. This may provide the user an opportunity to right the cup before liquid is spilled, or at least limit, if not entirely prevent, liquid from spilling from the cup if it is left on its side. The hood 21 may further limit the speed and quantity of unwanted spills. The shape of the cup may allow it to rest in this optimal side-lying position regardless of how it initially lands. The trough 16 may further impede the liquid from spilling when the cup is oriented other than for normal drinking, particularly if it lands or is placed upside down. The shape of the lid 2 may encourage the cup to fall on its side if placed upside down, but if not, the liquid must accumulate in the space between the insert 17 and the lid 2 at least as high as the length of the trough before liquid can reach the opening 12.

Whereas, the devices and methods have been described in relation to the drawings and claims, it should be understood that other and further modifications, apart from those shown or suggested herein, may be made within the spirit and scope of this invention.

What is claimed is:

1. A spill resistant cup comprising:

a substantially hollow body with a top and a bottom, where the bottom of the body is closed and the top of the body is open;

a lid with a top and at least one side wall, where the lid is removably attached to the body such that the lid spans the top of the body and where the top of the lid has an opening; and an insert located between and spaced from the top of the lid and the bottom of the body, where the insert has an opening and where the opening in the insert aligns with the opening in the lid;

where the body has one or more flat panels such that when the cup tips over the cup tends to rest on one of the one or more flat panels and where the at least one sidewall of the lid has one or more flat portions aligned with the one or more flat panels of the body.

2. The spill resistant cup of claim 1 where the body has one or more flat panels such that when the spill resistant cup tips over the spill resistant cup tends to rest on one of the one of more panels.

3. The spill resistant cup of claim 2 where the opening in the lid does not align with any of the one or more flat panels of the body.

4. The spill resistant cup of claim 1 where the body has a rim adjacent the top, the lid has a rim, and the lid removably attaches to the body via the two rims.

5. The spill resistant cup of claim 4 where the at least one sidewall of the lid comprises the rim of the lid.

6. The spill resistant cup of claim 4 where the rim of the body has a tab and the rib of the lid has a corresponding recess such that the lid may be removably attached to the body in only one orientation.

7. The spill resistant cup of claim 4 where the rim of the body has threads and where the rim of the lid has corresponding threads such that the lid may be screwed onto the body.

8. The spill resistant cup of claim 1 where the top of the lid has an opening, and where the top of the lid has a truncated hyperbolic paraboloid shape.

9. The spill resistant cup of claim 1 further comprising a trough located adjacent the opening in the lid such that liquid must travel along the trough to exit the cup via the opening in the lid.

10. The spill resistant cup of claim 1 where the lid further comprises a vent hole.

11. The spill resistant cup of claim 1 where the insert further comprises a vent hole.

12. The spill resistant cup of claim 11 where the vent hole in the insert and the opening in the insert are a single slit.

13. The spill resistant cup of claim 12 where the slit is parallel to the one or more flat panels.

14. The spill resistant cup of claim 1 where the insert is removably attached to the lid.

15. The spill resistant cup of claim 1 where the insert is integral to the lid.

16. The spill resistant cup of claim 1 further comprising a hood located between the opening in the insert and the opening in the lid.

17. The spill resistant cup of claim 1 further comprising one or more posts extending downward from the insert.

18. A spill resistant cup comprising:

a substantially closed vessel with an interior shape defining an interior space, where the vessel has a top and an opposing bottom, and where the vessel is shaped such that the vessel has one or more predictable landing positions, where a landing position is a position in which the spill resistant cup comes to rest when placed on a surface other than on its bottom;

an opening in the top of the vessel, where the opening is positioned such that the opening is not down when the cup is in any of the predictable landing positions; and an insert between the top and the bottom of the vessel with an opening aligned with the opening in the top of the vessel, where the insert has a perimeter matching the interior shape of the vessel at the location of the insert such that liquid cannot travel past the insert other than through the opening in the insert;

where the body has one or more flat panels such that when the cup tips over the cup tends to rest on one of the one or more flat panels and where the at least one sidewall of the lid has one or more flat portions aligned with the one or more flat panels of the body.

* * * * *